US005908194A

United States Patent [19]

Schachter et al.

[11] Patent Number: 5,908,194

[45] Date of Patent: Jun. 1, 1999

[54] SPORT TARGET DEVICE AND METHOD

[76] Inventors: Herbert L. Schachter, 34 Fieldstone Dr., Stoneham; Paul D'Entrement, 2261 Mass Ave., Lexington, both of Mass. 02180; David Levy, 16 Blake St., Cambridge, Mass. 02140; Michael Chiu, 17 Kidder Ave., Somerville, Mass. 02144

[21] Appl. No.: 09/016,700

[22] Filed: Jan. 30, 1998

[51] Int. Cl.[6] ..... A63B 69/38; F41J 5/06

[52] U.S. Cl. ..... 273/372; 473/462

[58] Field of Search ..... 273/371, 372, 273/374; 473/462

[56] References Cited

U.S. PATENT DOCUMENTS 2,939,706 6/1960 Skaredoff ..... 273/372

3,415,517 12/1968 Krist ..... 273/372 X 3,874,664 4/1975 Favrot et al. ..... 273/374 X 5,447,315 9/1995 Perkins ..... 273/372

*Primary Examiner*—William H. Grieb

[57] ABSTRACT

A durable, rigid, low-cost device to sense an impact of a ball over a wide area and to provide response to a user that said impact has occurred. The sensing mechanism is a low-cost acoustic sensor, acoustically coupled to an essentially single sheet of plastic material. Sensor electronics filter the input and measure amplitude to determine if a valid hit has occurred. If so, the device reports an activate signal to the response electronics that in turn provide feedback to the user by playing a digitally recorded audio message, recorded specifically for the event. Variously, the activate signal may be transmitted to a remote device that contains the response electronics.

8 Claims, 3 Drawing Sheets

SPORT TARGET DEVICE AND METHOD

FIELD OF THE INVENTION

This invention relates to training devices used to teach accuracy for sport, especially tennis.

BACKGROUND OF THE INVENTION

Accuracy is critical to sport. In tennis, for example, the serve is practiced with repetitive drills intended to develop an accurate and powerful serve. There are several methods known in the art for developing accuracy skills that provide user feedback. One is for the coach to build a pyramid consisting of four tennis balls. The balls are placed in a desired practice location and the player is instructed to hit the pyramid. When the pyramid is hit, the balls are scattered, the coach or player is forced to retrieve them, taking valuable time from practice sessions. Often it takes longer for the coach to set up the target than for the player to disrupt it. Placing multiple targets simultaneously is often counter productive as scattered pyramids frequently topple other pyramids.

While a number of electronic targets have been proposed to provide a more repeatable and less time-consuming feedback means, none are used, due to one or more of the following reasons:

1) Cost—Some of the prior art targets incorporate highly expensive components.
2) Poor simulation of normal playing conditions—While the player focuses primarily on accuracy, the coach analyses spin and power, as judged by the bounce after striking the target. An ideal tennis target will bounce the ball accurately after striking the target. Furthermore, an ideal target will have its topmost surface contiguous or nearly contiguous with the playing surface.
3) A sense of fun and mental stimulation—It is well-known that practice must remain fun and interesting to maintain player motivation. There is a sense of satisfaction that comes from scattering the pyramid of balls that is not provided by the "beep" or flash of prior art targets. An ideal target could be readily modified to provide customized feedback for each student thereby providing a sense of fun and mental interest.
4) Portability—Were targets useful and economically viable, they would be moved back and forth on a daily or even hourly basis, requiring them to be light and highly transportable in order to be practical. For example, at the beginning and end of each day, many targets (a dozen or so) would be moved simultaneously, necessitating lightness.
5) Adaptability—Targets must be easily adaptable to the needs of each student. They must allow ready placement to any location.

Prior art targets include most pertinently: U.S. Pat. No. 3,874,664 to Faurot et al. which offers a rigid flat panel, however with several drawbacks. The rigid sandwich construction, required to create an inner chamber capable of transmitting a pressure wave, necessitates a device of substantial thickness, thereby poorly mimicking the true nature of the playing surface both in terms of its thickness and in the deflection associated with a large diaphragm. Furthermore, pressure sensors are relatively expensive. The high weight of the device also renders it impractical. U.S. Pat. No. 3,415,517 to Krist employs metal wires or strips built into the court, providing a highly expensive and completely non-adaptable system. Indeed, the system was designed as a judging function, for which it performs well, but cannot be adapted to suit the present need. Other wide area sensors include a compliant, force sensitive top surface that strongly affects the flight of the ball and are therefore undesirable. Force sensitive materials such as force sensitive resistiors, and piezo films are far too expensive.

Therefore, what is desirable is a sport target that provides feedback to both player and coach that does not contain inherently expensive components. It is further desirable to simulate normal playing conditions with respect to both bounce and spin, and without having significant thickness. It is further desirable for the target to be light and portable so that a dozen may be comfortably carried to and from a storage facility to the place of use. It is yet further desirable to have a flexible feedback system between coach and student that allows the training regimen to remain varied and fun, a system that stimulates the mind as well as the muscles by offering variation and novelty in the practice regimen.

SUMMARY OF THE INVENTION

In this invention the above limitations are overcome and objects and advantages achieved by using an inexpensive electret microphone as the impact sensor of an essentially flat single sheet of rigid material, such as plastic. Acoustic waves that correspond with the natural frequency of the target shape and material propagate through the material toward a printed circuit board housed in an integrally molded cavity and to the microphone mounted thereon. The sensing circuitry may therefore be tuned to only respond to a specifically high amplitude of a particular frequency, thereby rejecting a wide range of random sounds which could cause false actuations, such as the ball striking proximate to the target, shouting, clapping, etc.

By using more than one sensor, and timing the arrival of the sound pulses at each, it is possible to triangulate a position anywhere upon the surface of the target. The device may be used on the ground or a wall.

Additionally, when the device is struck, the feedback mechanism provided to the player is a digitized recording, as recorded into the device by the coach or player at the beginning of the training session. The recording can be a selection of music, a joke, a word of advice or simply a laudatory comment. This design allows creative interplay within the context of the training session and helps keep it interesting and fun. Additional circuitry may provide random output from a variety of recorded samples. Additional objects and advantages of the invention will become apparent from a consideration of the drawings and ensuing descriptions of it.

BRIEF DESCRIPTION OF THE DRAWINGS

Other features and advantages of the invention will be apparent from the following description taken in connection with the accompanying drawings wherein.

DETAILED DESCRIPTION

Figure 1B:
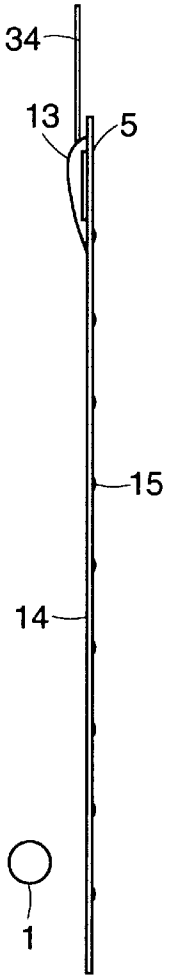
FIG. 1*b* shows the side view of the device.
Figure 1A:
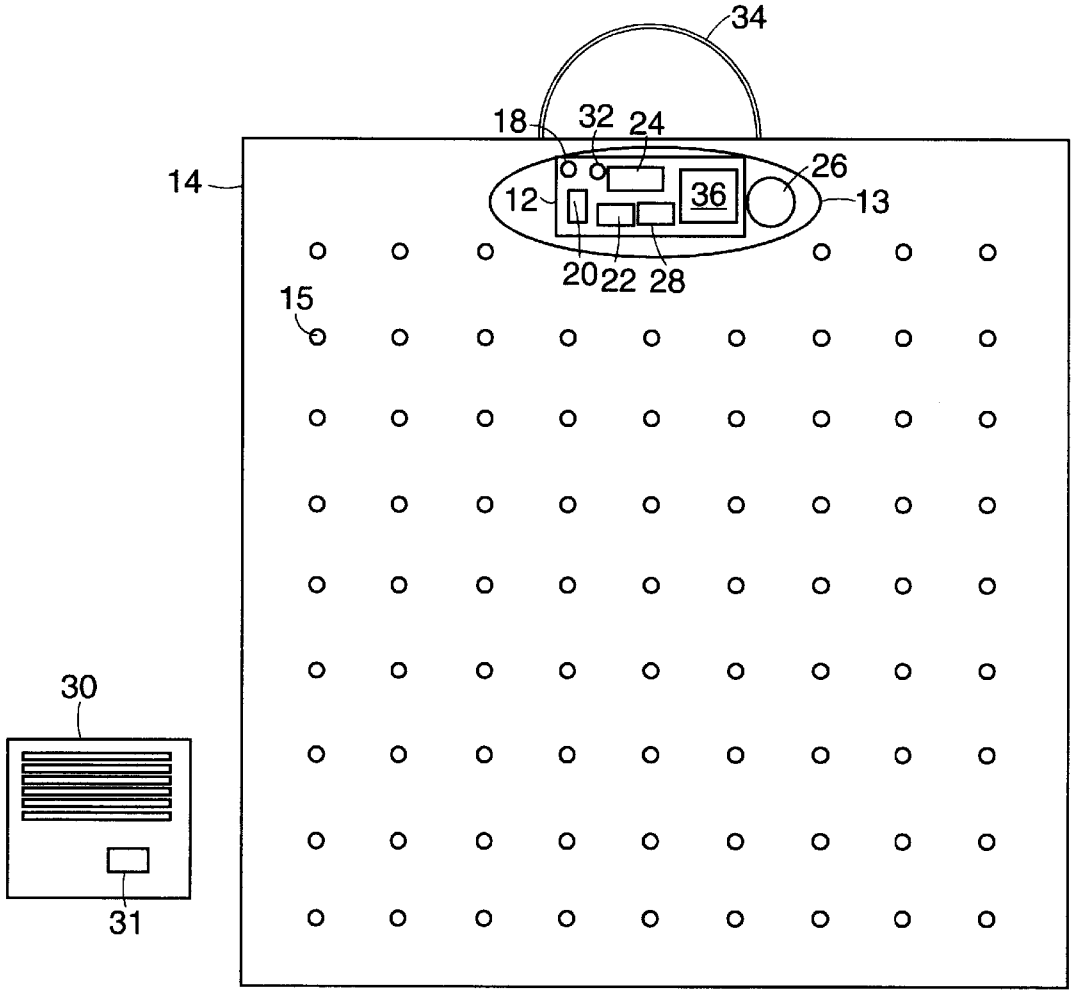
FIG. 1*a* shows a bottom view of the device with the electronics visible within the housing.

FIG. 1*a* shows a bottom view of the target with the printed circuit board 12 visible within housing 13 integrally thermoformed within target surface 14 of an ABS plastic shell. The contour of the housing 13 (seen better in FIG. 1*b*) is designed to be as small as possible and to minimize horizontal forces transmitted to the target on the rare occasions when it is struck by the ball. Bumps 15, located on the lower surface, elevate the target surface 14 approximately 30 thousands of an inch from the ground, allowing acoustic waves to transmit readily through the target surface 14 material without measurably affecting ball rebound. Therefore, as a ball strikes the target surface 14, an acoustic wave propagates through the material, through the printed circuit board 12 and to the microphone 18, preferably of an electret technology. The signal is filtered and amplified by the sensor circuitry 20 which then activates the digital recording playback circuitry 22 to play the pre-recorded sound though the amplification circuitry 24 and then through the speaker 26. Variously, the output signal from the sensor circuitry 20 may be sent through transmitter circuity 28 to a remote unit 30 that includes amplification circuitry 31 and that may then electronically note the hit event, and/or play a pre-recorded sound. The pre-recorded sound may be entered into the digital recording playback circuitry 22 via a recording microphone 32. Rope handle 34 allows the target to be easily carried or hung and operated from a hanging position. Batteries 36 supply power. By using more than one microphone 18, and timing the arrival of the sound pulses at each, it is possible to triangulate a position anywhere upon the surface of the target surface 14. The device may be used on the ground or hung vertically.

FIG. 1*b* demonstrates target surface 14 consisting of a single layer of material. Bumps 15 maintain a poor mechanical coupling between target surface 14 and any surface upon which the target rests, minimizing the loss of energy imparted from a projectile 1 to target surface 14 and maximizing transmission of this energy to the housing 13 where the signal will be processed by the electronics 5.

Figure 2:
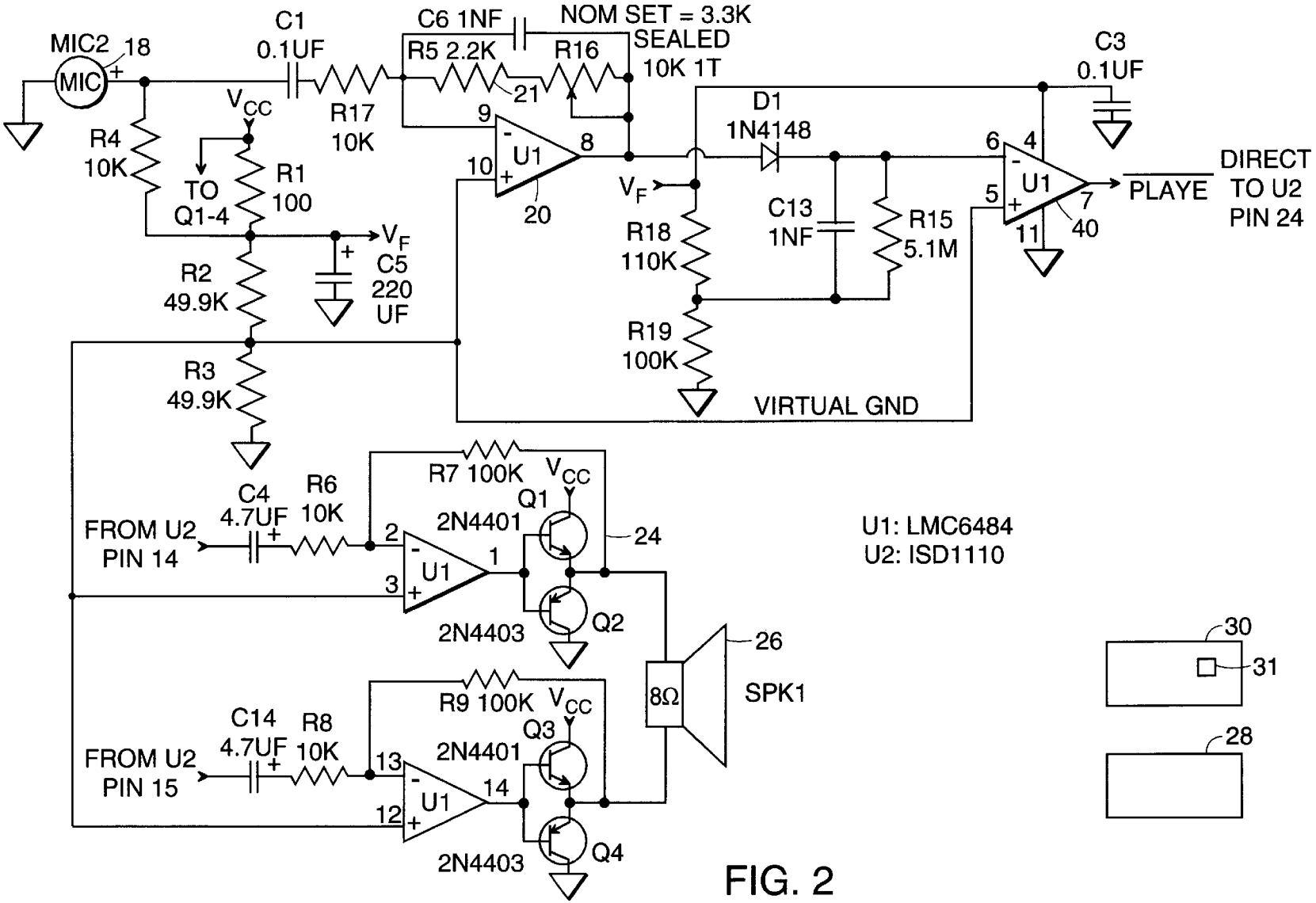
FIG. 2 shows a schematic of the target electronics, except for the sound recording and reproduction circuitry.
Figure 3:
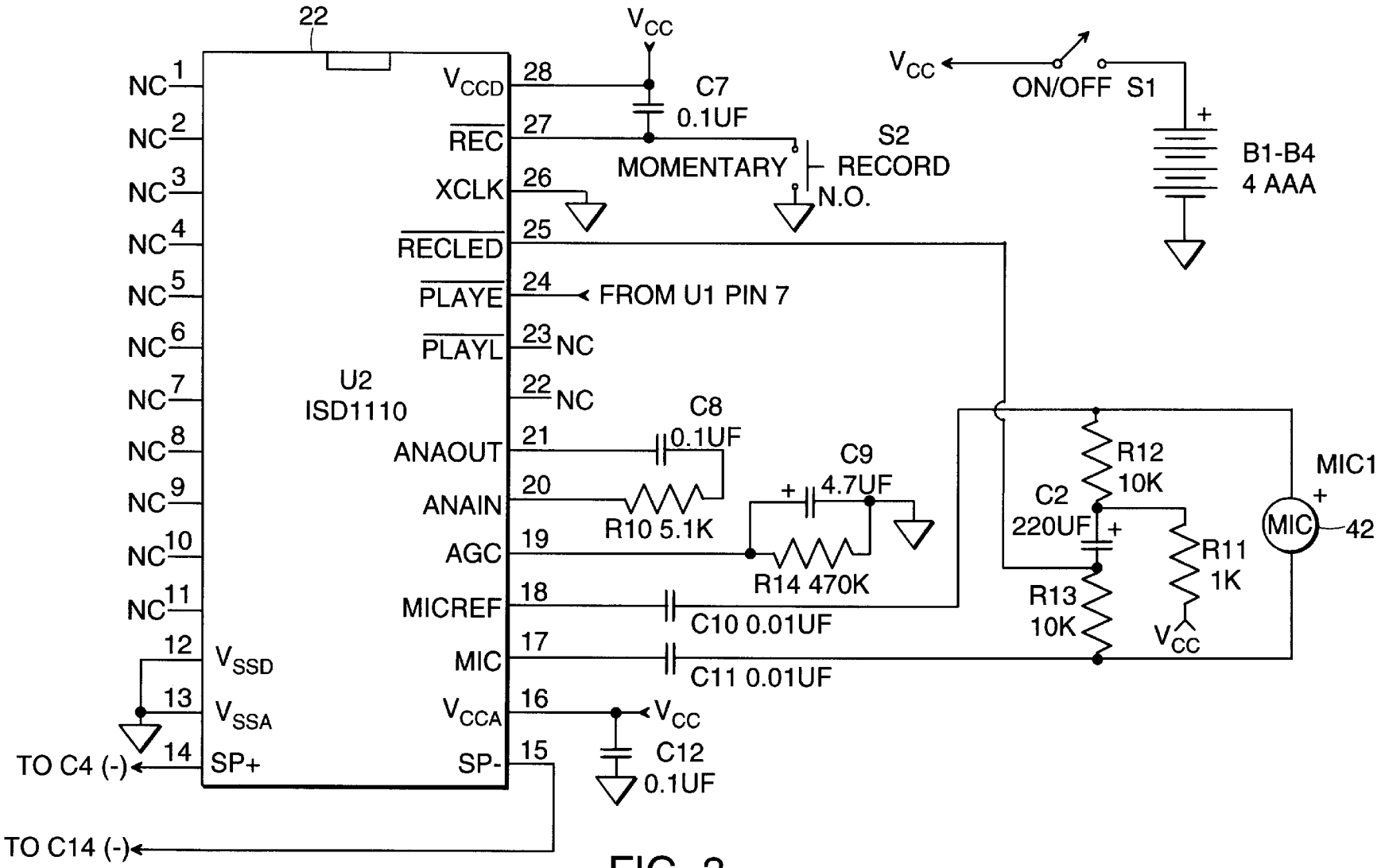
FIG. 3 shows a schematic of the sound recording and reproduction circuitry.

FIGS. 2 and 3 shows a schematic of the electronics 5. Referencing FIG. 2, the projectile 1 striking the target surface 14 creates an acoustic wave the propagates to the sensor microphone 18. Tuned circuitry 21 filters frequencies allowed to pass therethrough and is tuned to accept the peak frequencies associated with the geometry and material that comprise the target surface 14. Likewise tuned circuitry 21 rejects a wide range of non-desirable frequencies such as those associated with clapping, cheering, airplanes, and other noises common to a sports environment. Comparitor 40 determines if the amplitude is sufficient to warrant producing a feedback signal to the user. If the amplitude is high enough then the digital recording playback circuitry transmits a pre-recorded message to the amplification circuitry 24, and then to speaker 26 where it is heard as music or voice. A visual ouput, such as a flash of light or the activation of a waving mechanical flag, may also be provided. Referencing FIG. 3, the embodiment shown uses an Integrated Sound Devices 1110 integrated circuit as the digital recording circuitry 22 to record and reproduce sounds. The music or voice sounds are recorded through audio microphone 42.

Again referencing FIG. 2, the output signal from the sensor circuitry 20 may also be sent through transmitter circuity 28 comprised of technologies well-known in the art to a remote unit 30 which contains amplification circuitry 31 located within. Remote unit 30 may be placed across the court from the target, close to the player, thereby providing technical advantages such as reducing power requirements within the target and higher fidelity while also offering human factors advantages such as reducing the overall volume necessary for feedback to the player as well as minimizing the disturbance to players on adjacent courts.

While particular embodiments of the invention have been shown and described, it will be obvious to those skilled in the art that changes and modifications may be made without departing from this invention in its broader aspects. Therefore, the appended claims are to encompass within their scope all such changes and modifications as fall within the true spirit and scope of this invention. Accordingly, the scope of the invention should not be limited to the embodiment illustrated, but by the appended claims and their legal equivalents.

We claim:

1. A sport practice target device to sense an impact of a projectile upon said sport practice target device and to provide feedback to a user that said impact has occurred comprising:

a first target surface, said first target surface to be disposed substantially co-planar with a ground or wall surface;

a first housing, said housing rigidly coupled to said first target surface;

a sensor means disposed within said housing, said sensor means producing a first output signal in response to said impact;

a filter means, said filter means to accept said first output signal as input, said filter means to allow the passage of a set of frequencies associated with said impact upon the geometry and material of said first target surface and said housing in combination, said filter means to output a second output signal;

a signal measurement means to measure amplitude and frequency of said second output signal and to output an impact signal in the event said second output signal meets impact criteria associated with a threshold value of frequency and amplitude; and a response means, said response means to inform said user that said impact signal was generated by said signal measurement means.

2. The device of claim 1 wherein said first target surface consists of a single layer of sheet-like material, thereby achieving a minimum thickness.

3. The device of claim 2 wherein said single layer of sheet-like material is rigid.

4. The device of claim 3 wherein said single layer is elevated by a plurality of small protrusions on a lower surface.

5. The device of claim 1 wherein said response means comprises a digital recording circuit whereby a set of data stored within said digital recording circuit is transmitted as an audio signal to provide a meaningful audio response comprised of text or music to said user as a consequence of said impact.

6. The device of claim 5 wherein said set of data may be modifed by the user.

7. The device of claim 1 wherein said impact signal is transmitted to a second housing, said second housing to include said response means therewithin.

8. The device of claim 1 wherein said sensor means consists of an acoustic sensor disposed in acoustically coupled contact with said housing.

* * * * *